US005106089A

United States Patent [19]

Wood

[11] Patent Number: 5,106,089

[45] Date of Patent: Apr. 21, 1992

[54] LOTTERY SUMMING GAME

[75] Inventor: Michael W. Wood, Denham Springs, La.

[73] Assignee: BKE, Incorporated, Chicago, Ill.

[21] Appl. No.: 724,684

[22] Filed: Jul. 2, 1991

[51] Int. Cl.[5] ..... A63F 3/06

[52] U.S. Cl. ..... 273/139; 273/240; 283/903

[58] Field of Search ..... 273/139, 138 R, 240; 283/903, 901

[56] References Cited

U.S. PATENT DOCUMENTS 4,842,278 6/1989 Markowics ..... 273/138 A

OTHER PUBLICATIONS

Scarne's Encyclopedia of Games by John Scarne, "Race-Horse Keno", pp. 566-570, 1973.

*Primary Examiner*—Benjamin Layno

*Attorney, Agent, or Firm*—Jenner & Block

[57] ABSTRACT

The present invention consists of a lotto game wherein a player selects a play symbol representing a combination of play symbols from a set of play symbols. A set of winning play symbols are randomly selected and then compared to the combination of play symbols chosen by the player.

23 Claims, 3 Drawing Sheets

LOTTERY SUMMING GAME

TECHNICAL FIELD

The invention relates to the field of lottery games and in particular, it relates to lotto games where the player selects numbers that are drawn later in a random drawing.

BACKGROUND OF THE INVENTION

Traditionally, lottery games such as lotto and pick 3 and pick 4 games have been played by drawing random play symbols. Normally the play symbols which are used are numerals. To play a pick 3 or pick 4 game, a player first selects three or four numbers. Then, a drawing is held at a central location to determine the winning numbers. One system to select play symbols consists of repeatedly drawing objects, typically balls, which display different numerals. The balls are randomly mixed in a rotating drum. The drums can have either a group of receptacles or they can have a single receptacle from which the balls are drawn. If there are a group of receptacles, one ball is drawn from each receptacle. The combination and order of balls drawn constitutes the winning combination. If the balls are drawn from a single receptacle, the order of balls drawn and the numerals on those balls constitute the winning combination. If the numerals selected by the player are the same and in the identical order as the numerals drawn from the drums, the player wins the game. The amount of money won by the player is usually set for each game based on the probability of selecting the winning numbers in the order in which they are drawn.

Public interest in the lottery games generates much revenue for state governments. State lottery commissions earn more money by increasing lottery sales. Although lotteries have been successful, it is considered desirable to increase the profitability of the lotteries. By limiting games played to traditional lottery games, player interest and profitability has been limited.

SUMMARY OF THE INVENTION

It is an object of this invention to provide a method of playing a lotto game wherein a group of winning play symbols are randomly selected from a set of play symbols. The play symbol is hereinafter defined as any type of symbol which can be used in lottery games, e.g., numbers and play card symbols. A player first selects a number or other play indicia which represents a combination of the play symbols taken from the set of play symbols. After the player selects the number or other play indicia, a set of winning play symbols are randomly selected from the set of play symbols by a drawing. Upon drawing of the winning play symbols, the player compares the bet which he selected to the winning play symbols to determine if he has won the game.

It is an additional object of the present invention to provide a ticket wherein one or more play indicia representing combinations of possible play symbols to be drawn in a game are selected by a player. In one configuration of the invention where the play symbols are numbers, winning indicia which represent the sum selected by a player of possible numbers to be drawn are printed on the ticket. In addition, time indicia is printed on the ticket prior to the random selection of winning numbers.

It is yet another object of the present invention to provide a bet slip for use with a lotto game wherein a group of winning play symbols are selected from a set of play symbols. In one configuration of the present invention which utilizes numbers, the bet slip has at least one bet indicia to be marked by a player indicating a number which represents a predetermined mathematical combination such as the sum of the winning numbers. A pay indicia indicating the winning amount for the associated bet indicia is also provided on the bet slip.

DETAILED DESCRIPTION OF THE INVENTION

Figure 1:
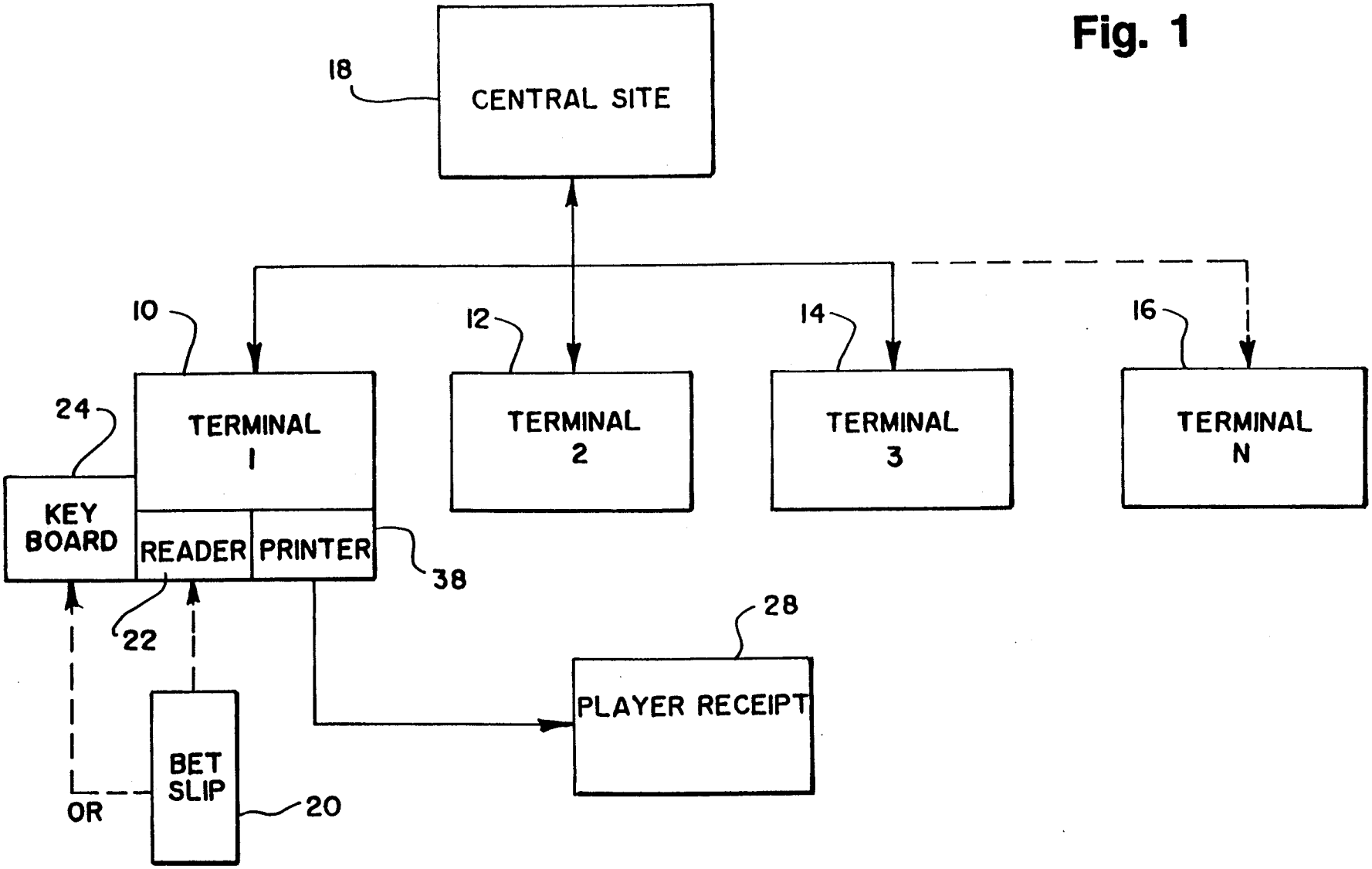
FIG. 1 is a block diagram illustrating a method of playing a lotto game.

FIG. 1 represents a method of playing a lotto game according to an embodiment of the present invention. As is conventional with the lotto game, a group of terminals 10, 12, 14 and 16 are provided for player interaction with a central site 18 where the winning lotto draws are made. Any number of terminals can be provided by the local lottery commission depending upon such factors as location and amount of use. For the purposes of this discussion, each terminal illustrated in the drawings directly corresponds to member 10. At the terminal 10, the player selects a bet. Depending upon the type of terminal 10, the player can either use a bet slip 20 which he or an agent inserts into a reader 22 or can type his selection via a key board 24 to play the lotto game.

Figure 2:
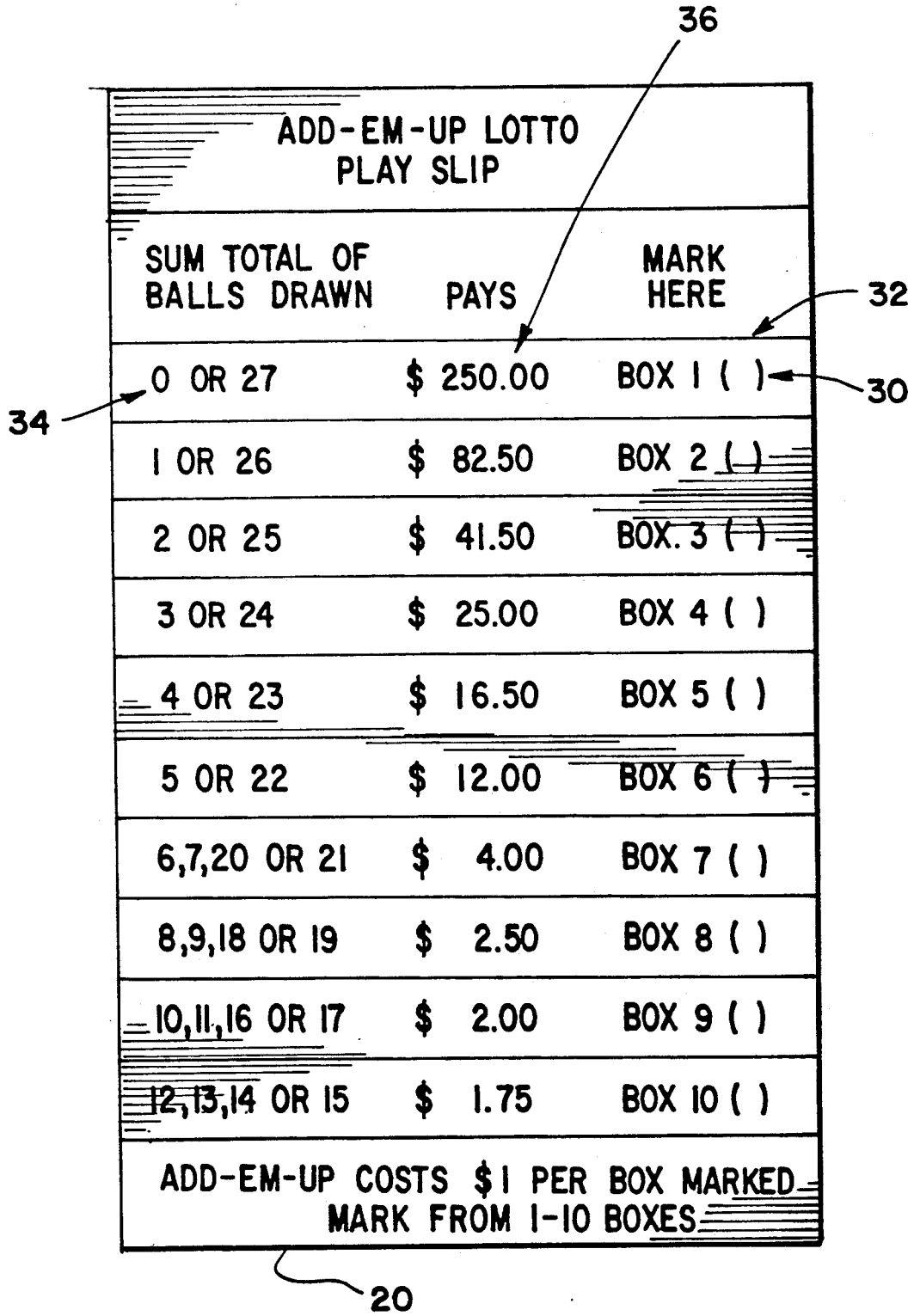
FIG. 2 is a plan view of the front side of a bet slip of the present invention.

To play the lotto game which can also be played in conjunction with a number of lottery games such as Poker, Pick 3, Pick 4, Keno, Bingo, etc., the player first selects a bet such as 30 on the bet slip 20 in FIG. 2. The bet 30 is selected from a set of bets 32 which corresponds to a combination of play symbols 34 to be randomly selected from a set of play symbols at the central site 18. Any variety of play symbols such as numbers, playing card symbols, and so forth can be used, the type of play symbol selected being conditioned on the type of game being played.

In the embodiment illustrated in FIG. 2, the play symbols 34 are numerals and the bet 30 is selected from a set of bets which corresponds to a mathematical combination of numbers. For example, in a pick 3 game, three balls, each of which may have numbers or symbols ranging from zero to nine, are randomly selected at the central site 18. Therefore, the player would select as his bet 36 two numbers representing possible sums of the numbers on the balls to be randomly drawn.

Figure 3:
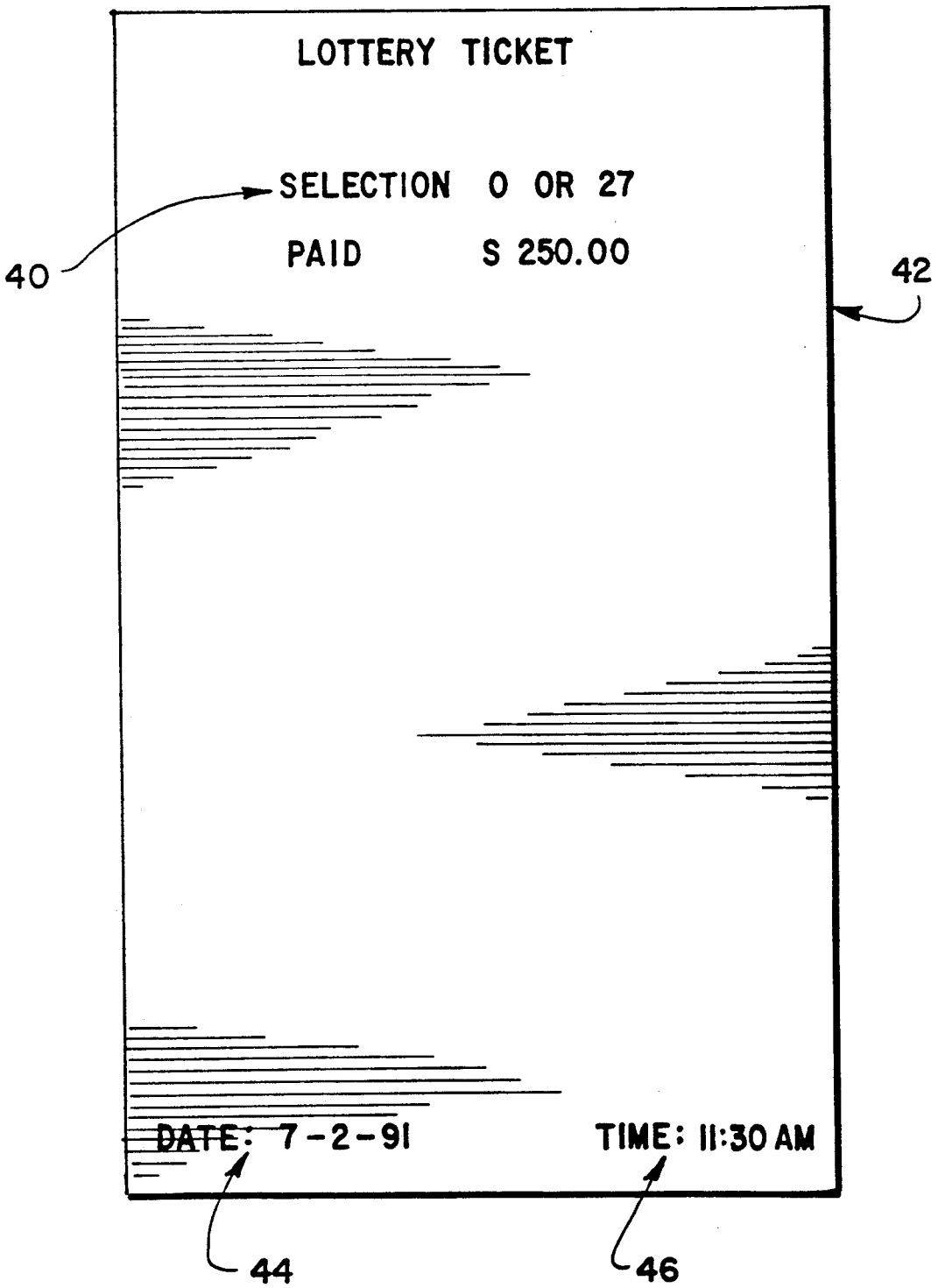
FIG. 3 is a plan view of the front side of a lottery ticket of the present invention.

After the player selects his bet 30 and its associated pay indicia representing the winning amount seen generally at 36, either by the bet slip 20 or by having typed his choice on the key board 24, a printer 38 prints his selection 40 on a lottery ticket 42 as shown in FIG. 3. In addition, to printing the selection 40, the printer prints the date 44 and time 46 of the purchase of the ticket 42, the date 44 and time 46 being prior to the drawing of the random set of winning numbers at the central site 18.

After the ticket 42 has been purchased, the drawing of the set of winning play symbols is held at the central site 18. A set of winning play symbols are randomly selected from the set of play symbols at the central site 18. Depending upon the game being played, a win can represent a number of different combinations or sums of the winning play symbols.

In the embodiment illustrated in FIG. 2, the combination of play symbols is the mathematical combination 34 of the sum of the winning numbers. As an example, if the three balls drawn at the central site 18 in pick 3 lotto each having the number nine, then the winning combination would be twenty-seven. In addition, other mathematical combinations of the winning numbers can be used such as combinations of odd and even numbers. For example, in the pick 3 lotto game, three balls, each of which may have numbers or symbols ranging from zero to nine, would be randomly drawn. If the player bets that the balls would be all odd numbered balls, and the balls selected at the central site 18 are 3, 5 and 9, the player would win the bet. Similarly, if the player bets that all the balls are even numbered, and the balls selected at the central site 18 are 2, 6, and 8, the player would win the bet. Not only can a player bet that all the balls selected will be either all even or odd, but he can bet on numerous other possible permutations and combinations of odd and even numbers. One possible bet in a pick 3 lotto game would be 2 odd numbered balls and one even numbered ball. Another possible bet would be 2 even numbered balls and one odd numbered ball.

Bets consisting of ranks of numbers are also contemplated. One example of this embodiment is the consecutive combination of numbers. In a pick 3 lotto game, a player could bet that the numbers drawn at the central site will be in ascending order, e.g., 1, 3, and 5 or he could bet that they will be in descending order 6, 5, and 4. Another method of ranking numbers is classifying numbers into groups. In a pick 3 lotto game, one group of numbers could be 1, 4, 7, a second group, 2, 5, and 8 and a third 3, 6, and 9. In this embodiment, the player would wager that the numbers selected at the central site would be those found in his chosen group.

Upon drawing the set of winning play symbols, the player compares the combination corresponding to his chosen bet indicia to the combination of selected play symbols. If the player's bet 30 matches the combination of winning play symbols, the player wins the amount of money indicated in pay indicia 36 and he can redeem the ticket 20 for payment of the specified amount.

I claim:

1. A method of playing a lotto game wherein a plurality of winning play symbols are randomly drawn from a set of play symbols, the method comprising the steps of:

each player selecting at least one bet indicia, each bet indicia representing predetermine a combination of a group of play symbols from the set of play symbols;

randomly drawing a group of winning play symbols from the set of play symbols; and each player comparing said combination of said winning play symbols to said group of play symbols in said bet indicia said player selected.

2. The method of claim 1 wherein said play symbols and said set of play symbols are numbers, said player bet being a mathematical combination of a group of numbers from said set of numbers and said set of winning play symbols being selected from said set of numbers.

3. The method of claim 2 wherein said mathematical combination represents the sum of said winning numbers.

4. The method of claim 2 wherein said mathematical combination represents odd or even combinations of winning numbers.

5. The method of claim 2 wherein said mathematical combination represents consecutive combinations of numbers.

6. The method of claim 2 wherein said mathematical combination represents groups of numbers.

7. The method of claim 1 wherein said play symbols and said set of play symbols are play card symbols, said player bet being a combination of a group of play card symbols from said set of play card symbols and said set of winning play symbols being a set of play card symbols.

8. The method of claim 1 additionally including printing a ticket having time indicia printed thereon prior to said selection of the random play symbols.

9. A lotto ticket for use with a lotto game wherein a plurality of winning play symbols are randomly drawn from a set of play symbols comprising:

a bet indicia printed on the ticket, bet indicia representing a predetermined combination of a group of play symbols in the set; and a time indicia printed on the ticket representing a time prior to the random drawing of said winning play symbols.

10. The ticket of claim 9 wherein said play symbols and said set of play symbols are numbers.

11. The ticket of claim 10 wherein said bet indicia represents the sum of said group of numbers.

12. The ticket of claim 10 wherein said bet indicia represents a combination of odd numbers or even numbers.

13. The ticket of claim 10 wherein said bet indicia represents a combination of consecutive numbers.

14. The ticket of claim 10 wherein said bet indicia represents a combination of a group of numbers.

15. The ticket of claim 9 wherein said play symbols and said set of play symbols are playing card symbols, and said winning play symbols being winning playing card symbols.

16. The ticket of claim 9 wherein the ticket includes a plurality of bet indicia.

17. A bet slip for use with a lotto game wherein a plurality of winning play symbols is randomly drawn from a set of symbols comprising:

at least one bet indicia marked by players, each bet indicia representing a predetermined combination of play symbols from the set of symbols; and a pay indicia printed on the slip associated with each of said bet indicia representing a winning amount for its associated bet indicia.

18. The bet slip of claim 17 wherein said play symbols are numbers.

19. The bet slip of claim 18 wherein said predetermined combination of play symbols represents a sum of selected numbers from the set of symbols.

20. The bet slip of claim 18 wherein said predetermined combination of play symbols represents a combination of odd numbers or even numbers.

21. The bet slip of claim 18 wherein said predetermined combination of play symbols represents a combination of consecutive numbers.

22. The bet slip of claim 18 wherein said predetermined combination represents a combination of a group of numbers.

23. The bet slip of claim 17 wherein said play symbols are playing card symbols.

* * * * *